US007038175B2

(12) United States Patent
Henninger et al.

(10) Patent No.: US 7,038,175 B2
(45) Date of Patent: May 2, 2006

(54) METHOD AND APPARATUS FOR A SELF-CLEANING OVEN

(75) Inventors: Brian Scott Henninger, LaGrange, KY (US); Paul Bryan Cadima, Prospect, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/880,839

(22) Filed: Jun. 30, 2004

(65) Prior Publication Data

US 2006/0011606 A1 Jan. 19, 2006

(51) Int. Cl.
*F27D 11/00* (2006.01)

(52) U.S. Cl. ..... 219/394; 219/385; 219/393; 219/395; 219/391; 219/214; 219/219; 99/357; 99/386; 99/450; 99/483; 372/236; 372/198; 372/351.4; 124/339; 124/273 R

(58) Field of Classification Search ..... 219/385, 219/393–395, 391, 398, 214, 219; 99/357, 99/386, 443 R, 450, 483; 372/236, 198–199, 372/351.4, 351.5, 330.1; 126/339, 273 R, 126/275 R, 275 E See application file for complete search history.

(56) References Cited

U.S. PATENT DOCUMENTS

| | | | | |
|---|---|---|---|---|
| 3,819,247 | A | 6/1974 | Evans | |
| 4,444,175 | A | 4/1984 | Reynolds | |
| 4,718,400 | A | 1/1988 | Lotz et al. | |
| 4,759,341 | A | 7/1988 | McFarland | |
| 6,166,353 | A | 12/2000 | Senneville et al. | |
| 6,191,391 | B1 * | 2/2001 | Deo et al. | 219/407 |

* cited by examiner

*Primary Examiner*—Shawntina Fuqua
(74) *Attorney, Agent, or Firm*—H. Neil Houser, Esq.; Armstrong Teasdale LLP

(57) ABSTRACT

An oven assembly that includes a first oven cavity including a self-cleaning feature, a first pair of opposing walls, and a second pair of opposing walls, wherein the walls are coupled together to define a first volume within the first oven cavity, and a second oven cavity coupled to the first oven cavity, wherein the second oven cavity includes a first pair of opposing walls and a second pair of opposing walls coupled together to define a second volume within the second oven cavity, each of the first walls includes a slide rail coupled thereto, and a drawer frame slidably coupled to the slide rails and selectively sized to receive a drawer such that the drawer is removable from the second oven cavity and positionable within the first oven cavity to facilitate cleaning the drawer utilizing the self-clean feature of the first oven cavity.

18 Claims, 3 Drawing Sheets

METHOD AND APPARATUS FOR A SELF-CLEANING OVEN

BACKGROUND OF THE INVENTION

This invention relates generally to an oven assembly, and more particularly, to a method and apparatus used with the self-cleaning oven.

At least some known ovens includes multiple heating elements that are used for multiple operations, such as, for instance, baking, broiling, and self-cleaning. Substances baked or broiled inside the oven may generate materials, such as, for example, grease, which over time may become undesirably deposited on the walls defining the oven chamber and/or any apparatuses used within the oven cavity such as, for example, a broiling tray. Operating the self-cleaning function of the oven facilitates removing deposited materials.

At least one known self-cleaning oven includes a drawer beneath the oven which may be utilized to store various articles, such as cooking pots and/or broiling pans. More specifically, at least some known oven drawers are only useful for storage purposes, and do not include any means for heating substances placed therein.

In contrast, at least one known oven includes a secondary oven cavity positioned beneath a primary oven cavity that is sized to receive a broiling tray therein. A broiling element is positioned above the broiling tray to accomplish the broiling function.

However, cleaning the secondary oven cavity after frequent usage can be problematic. Specifically, within such known cavities, removing the broiling tray from the secondary oven cavity enables the secondary oven cavity to be cleaned by hand. Since known secondary oven cavities do not include a self-cleaning feature, cleaning such cavities and the broiling tray may be a time consuming task that may result in damage to the secondary oven cavity and/or broiler tray coatings.

BRIEF SUMMARY OF THE INVENTION

In one aspect, a method of assembling an oven is provided. The method includes providing a first oven cavity that includes a self-cleaning feature, a first pair of opposing walls, and a second pair of opposing walls, wherein the walls are coupled together to define a first volume within the first oven cavity, and coupling a second oven cavity to the first oven cavity, wherein the second oven cavity includes a first pair of opposing walls and a second pair of opposing walls coupled together to define a second volume within the second oven cavity, each of the first pair of walls including a slide rail coupled thereto, a drawer frame slidably coupled to each slide rail and selectively sized to receive a drawer such that the drawer is removable from the second oven cavity and positionable within the first oven cavity to facilitate cleaning the drawer utilizing the self-clean feature of the first oven cavity.

In another aspect, an oven drawer assembly is provided. The oven drawer assembly includes a drawer frame slidably coupled to a pair of slide rails, and a drawer positioned within the drawer frame, wherein the drawer frame is selectively sized to receive the drawer such that the drawer is removable from a second oven cavity and positionable within a first oven cavity to facilitate cleaning the drawer utilizing a self-clean feature of the first oven cavity.

In a further aspect, an oven assembly is provided. The oven assembly includes a first oven cavity including a self-cleaning feature, a first pair of opposing walls, and a second pair of opposing walls, wherein the walls are coupled together to define a first volume within the first oven cavity, and a second oven cavity coupled to the first oven cavity, wherein the second oven cavity includes a first pair of opposing walls and a second pair of opposing walls coupled together to define a second volume within the second oven cavity, each of the first walls includes a slide rail coupled thereto, and a drawer slidably coupled to the slide rails such that the drawer is removable from the second oven cavity and positionable within the first oven cavity to facilitate cleaning the drawer utilizing the self-clean feature of the first oven cavity.

DETAILED DESCRIPTION OF THE INVENTION

Figure 1:
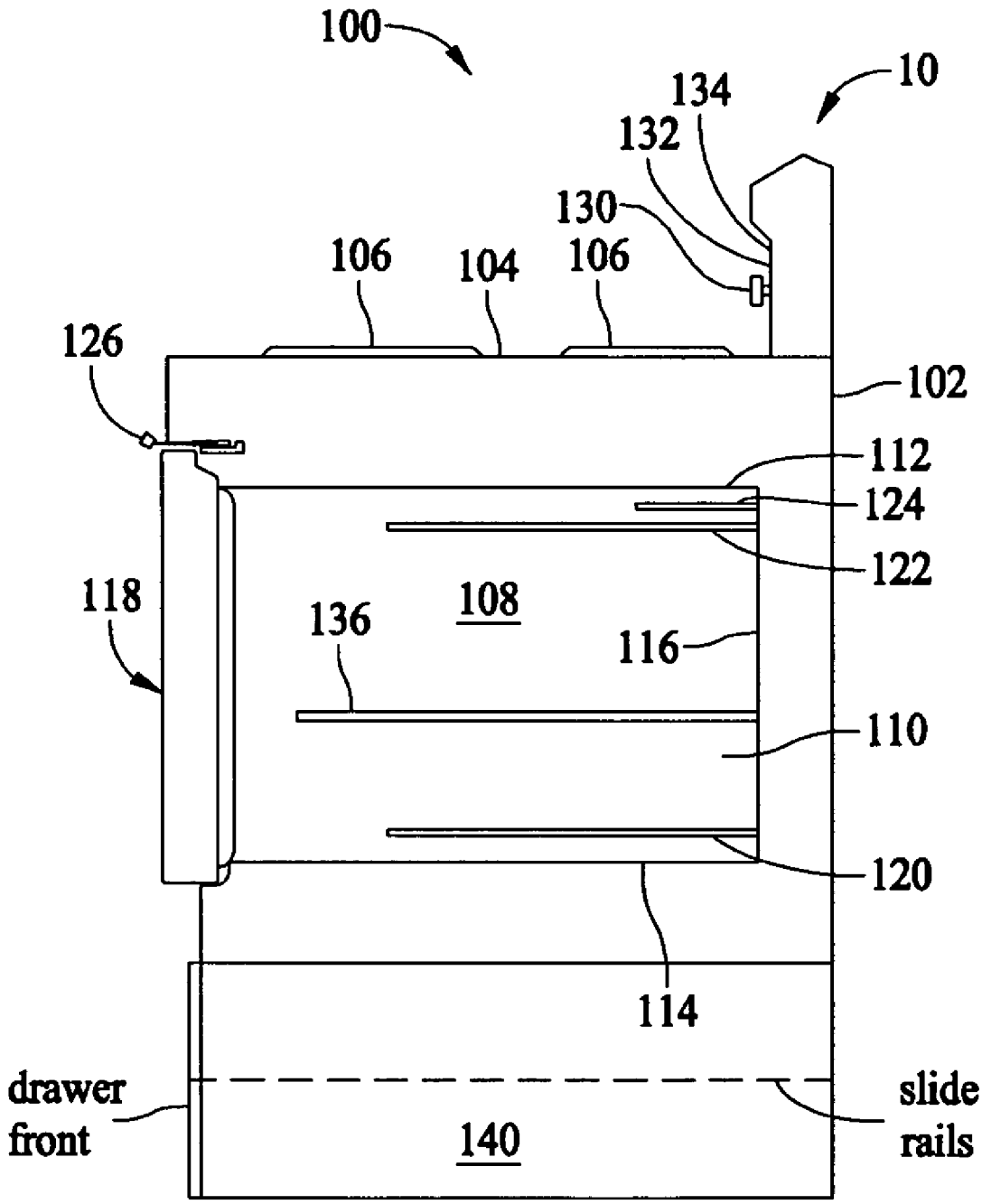
FIG. 1 is a front view of an exemplary oven assembly.

FIG. 1 is an exemplary embodiment of an oven assembly 10 that includes a self-cleaning cooking platform 100 and a second cooking platform 200. While a free standing electric range is shown, it will be understood that the method and apparatus described herein are equally applicable to other self-cleaning oven products as well. Examples of other oven products include a speedcooking oven, a wall oven, and a gas oven.

Oven 100 includes an outer cabinet 102 and a top cooking surface 104 having a plurality of individual surface heating elements 106. Positioned within cabinet 102 is a cooking chamber 108 or cavity formed by a box-like oven liner having at least two vertical side walls 110, a top wall 112, a bottom wall 114, a rear wall 116, and a front opening drop door 118. Cooking chamber 108 is provided with two heating elements, a bake heating element 120 positioned adjacent bottom wall 114 and a broil heating element 122 positioned adjacent top wall 112.

A temperature probe or sensor 124 is mounted to project into chamber 108 and senses a temperature within cooking chamber 108. A door latch handle 126 is used for locking door 118 in a closed position during a self-cleaning operation. A control knob 130 extends outwardly from a control panel 132, which is supported from a back splash 134 of range 100. In the exemplary embodiment, range 100 also includes at least one cooking rack 136 positioned within cooking chamber 108. In the exemplary embodiment, oven assembly 10 also includes a second cooking platform 140 that is coupled to and positioned beneath self-cleaning cooking platform 100.

Figure 2:
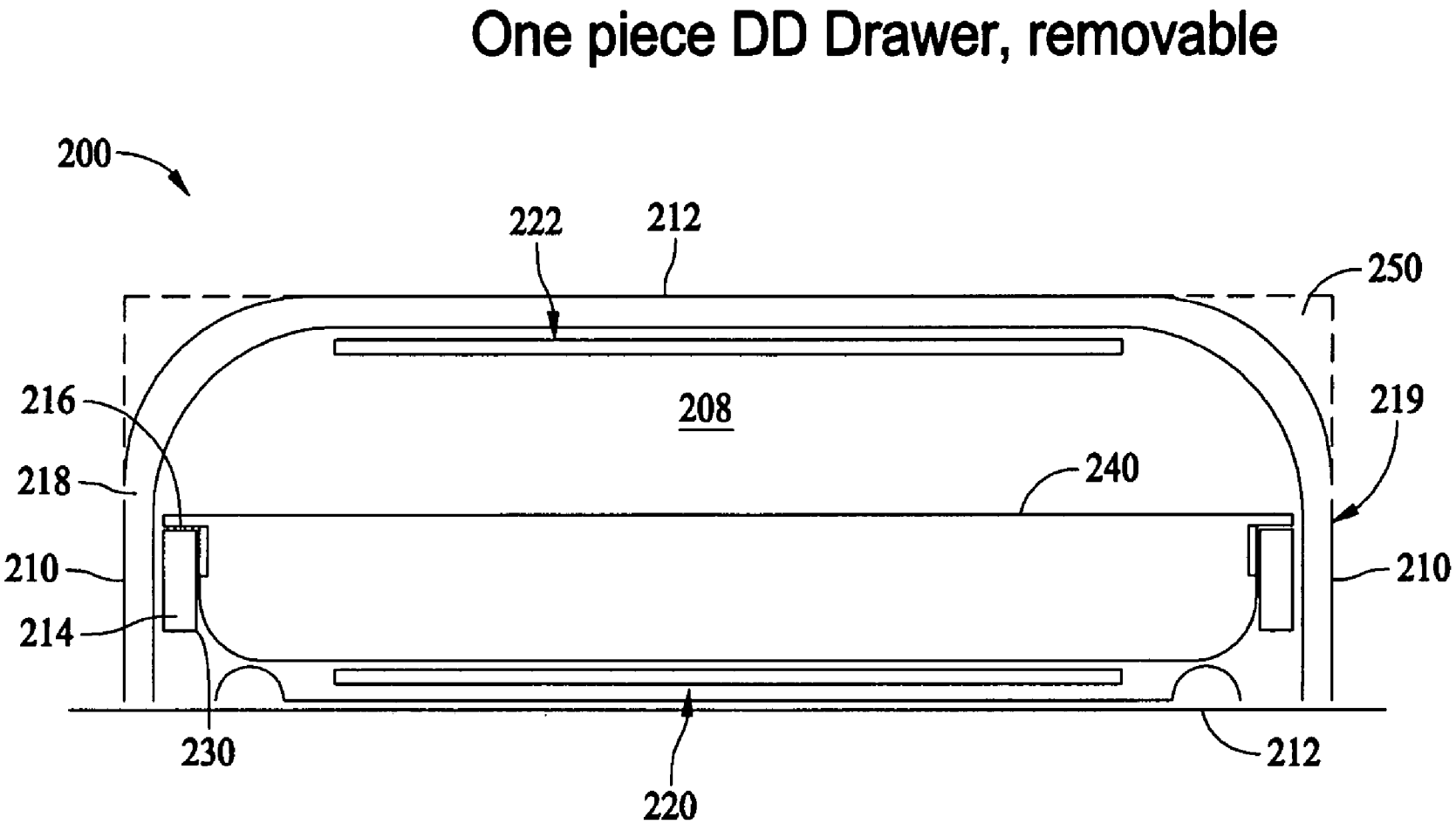
FIG. 2 is a front view of an exemplary cooking platform that can be used with the oven assembly shown in FIG. 1.

FIG. 2 is a front view of exemplary cooking platform 200 that can be used with oven assembly 10 (shown in FIG. 1). While an oven is described, it will be understood that the method and apparatus described herein are equally applicable to other non-self-cleaning oven products as well. Examples of other oven products include a wall oven, and a gas oven.

Positioned within oven 200 is a second oven cavity 208 formed by a box-like oven liner having a first pair of opposing walls 210 and a second pair of opposing walls 212. First and second pair of opposing walls 210 and 212 define a second volume within second oven cavity 208. Each of first pair of walls 210 includes a slide rail 214 coupled thereto. Second oven cavity 208 is provided with a lower baking element 220 positioned adjacent to the lower of the second pair of opposing walls 212, and an upper broiling element 222 positioned adjacent to the upper of the second pair of opposing walls 212.

Second oven cavity 208 is further provided with a drawer frame 230 slidably coupled to each slide rail 214 by a plurality of slides 216 disposed therebetween. Drawer frame 230 is selectively sized to receive a drawer 240, such that drawer 240 is removable from second oven cavity 208 and positionable upon cooking rack 136 within cooking chamber 108 (shown in FIG. 1) to facilitate cleaning drawer 240 utilizing the self-clean feature of cooking chamber 108. Therefore, drawer 240 can be cleaned without requiring a self-cleaning feature in second oven cavity 208, thereby reducing design and manufacturing costs.

In the exemplary embodiment, drawer 240 is a one-piece deep drawn style, which permits drawer 240 to be heated to a high temperature without deforming. Exemplary drawer 240 is positioned between baking element 220 and broiling element 222 within second oven cavity 208, and exemplary drawer 240 has an exterior surface coated with a pyrolitic enamel material. More specifically, food is positioned within drawer 240 and heated to a desired temperature. Therefore, drawer 240 facilitates retaining any undesired deposits such as, for example, grease, which over time may become undesirably deposited on a surface of drawer 240 within drawer 240. Drawer 240 is then removed from second oven cavity 208 and placed within first oven cavity 108. The self-cleaning feature of first oven cavity 108 is then initialized to remove the undesired deposits formed on drawer 240.

A drawer front 250 is coupled to drawer frame 230, such that drawer 240 can slide out from second oven cavity 208 together with drawer frame 230 by pulling drawer front 250. Second oven cavity 208 also contains a gasket 218 coupled thereto and an insulating material 219 covering at least a portion of second oven cavity 208. When drawer 240 slides into second oven cavity 208, gasket 218 extends in sealing contact between second oven cavity 208 and drawer front 250, and works together with insulating material to facilitate retaining heat within second oven cavity 208.

Figure 3:
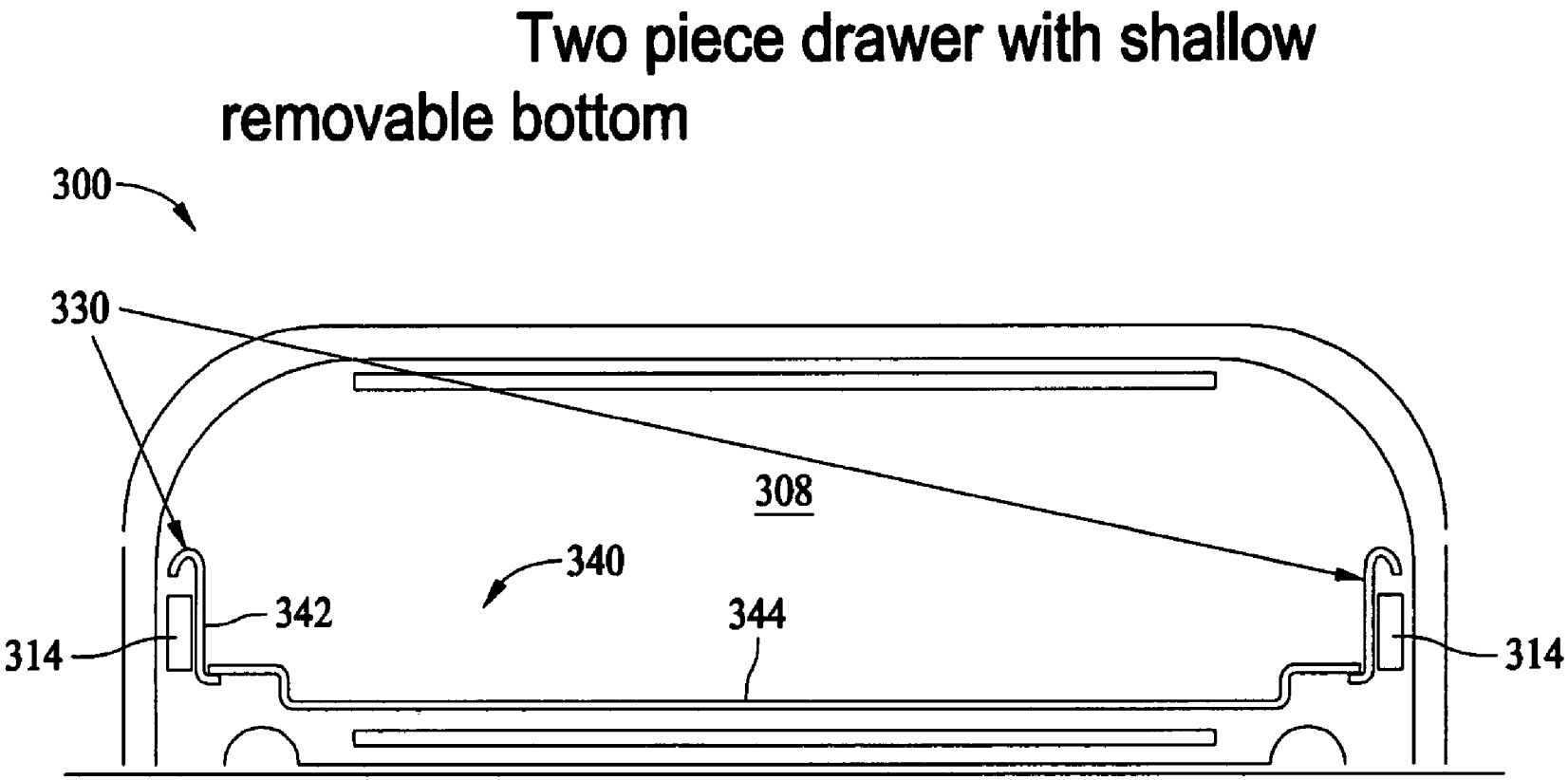
FIG. 3 is a front view of an exemplary cooking platform that can be used with the oven assembly shown in FIG. 1.

FIG. 3 is a front view of exemplary cooking platform 300 that can be used with oven assembly 10 (shown in FIG. 1). While an oven is described, it should be understood that the method and apparatus described herein are equally applicable to other non-self-cleaning oven products as well. Examples of other oven products include a wall oven and a gas oven.

It should be understood that oven 300 is similar to oven 200, except that oven 300 includes a different drawer frame 330 and a different drawer 340. Drawer frame 330 is positioned within a second oven cavity 308, and is slidably coupled to a plurality of slide rails 314. Drawer 340 includes two first portions 342 integrally formed with drawer frame 330 and a removable bottom portion 344 coupled horizontally with first portions 342. Removable bottom portion 344 is removable from second oven cavity 308 and is positionable upon cooking rack 136 within cooking chamber 108 (shown in FIG. 1) to facilitate cleaning removable bottom portion 344 utilizing the self-cleaning feature of cooking chamber 108.

The cooking drawers described herein facilitate retaining undesirable cooking deposits within the cooking drawers. The cooking drawers are then removed from the second cooking cavity and positioned within the first cooking cavity. The self-clean feature of the first cooking cavity is then activated to remove the undesired deposits from the removable second cooking cavity, i.e. the removable drawer. Accordingly, the removable drawer functions as a second cooking cavity that is selectively sized to be positioned within the first cooking cavity to facilitate cleaning the second cooking cavity.

Exemplary embodiments of combinations of apparatuses and methods are described above in detail. The combinations are not limited to the specific embodiments described herein, but rather, components of each apparatus and method may be utilized independently and separately from other components described herein.

While the invention has been described in terms of various specific embodiments, those skilled in the art will recognize that the invention can be practiced with modification within the spirit and scope of the claims.

What is claimed is:

1. A method of assembling an oven, said method comprising:

providing a first oven cavity that includes a self-cleaning feature, a first pair of opposing walls, and a second pair of opposing walls, wherein the walls are coupled together to define a first volume within the first oven cavity; and coupling a second oven cavity to the first oven cavity, wherein the second oven cavity includes:

a first pair of opposing walls and a second pair of opposing walls coupled together to define a second volume within the second oven cavity, each of the first pair of walls including a slide rail coupled thereto, a drawer frame slidably coupled to each slide rail and selectively sized to receive a drawer such that the drawer is removable from the second oven cavity and positionable within the first oven cavity to facilitate cleaning the drawer utilizing the self-clean feature of the first oven cavity.

2. A method of assembling an oven in accordance with claim 1 further comprising:

coupling a gasket to the second oven cavity, and coupling a drawer front to the drawer frame, such that the gasket extends in sealing contact between the second oven cavity and the drawer front to facilitate retaining heat within the second oven cavity.

3. A method of assembling an oven in accordance with claim 1 further comprising coupling at least a first cooking element within the second oven cavity.

4. A method of assembling an oven in accordance with claim 1 wherein the drawer includes a first portion, said method further comprises coupling said first portion to a removable bottom portion.

5. A method of assembling an oven in accordance with claim 1 further comprising coupling an insulating material to at least a portion of the second oven cavity.

6. A method of assembling an oven in accordance with claim 1 further comprising depositing a pyrolitic enamel material across an exterior surface of the drawer.

7. An oven drawer assembly comprising:

a drawer frame slidably coupled to a pair of slide rails, and a drawer positioned within said drawer frame, said drawer frame sized to receive said drawer such that said drawer is removable from a second oven cavity and positionable within a first oven cavity including a cooking rack, said drawer positionable upon the cooking rack to facilitate cleaning said drawer utilizing a self-cleaning feature of the first oven cavity.

8. An oven drawer assembly in accordance with claim 7 wherein the second oven cavity includes a baking element and a broiling element, said drawer selectively sized to be positioned between the baking element and the broiling element within the second oven cavity.

9. An oven drawer assembly in accordance with claim 7 wherein the second oven cavity includes a first pair of opposing walls and a second pair of opposing walls coupled together to define a second volume, said pair of slide rails coupled within the second oven cavity.

10. An oven drawer assembly in accordance with claim 7 wherein said drawer comprises a first portion and a removable bottom portion coupled to said first portion.

11. An oven drawer assembly in accordance with claim 7 wherein said drawer comprises an exterior surface coated with a pyrolitic enamel material.

12. An oven assembly comprising:

a first oven cavity comprising a self-cleaning feature, a first pair of opposing walls, and a second pair of opposing walls, said first and second pairs of walls coupled together to define a first volume within said first oven cavity; and a second oven cavity coupled to said first oven cavity, wherein said second oven cavity comprising:

a first pair of opposing walls and a second pair of opposing walls coupled together to define a second volume within said second oven cavity, each of said second oven cavity first pair of walls comprising a slide rail coupled thereto, and a drawer frame slidably coupled to each said slide rail, said drawer frame sized to receive a drawer comprising a first portion and a bottom portion removably coupled to said first portion such that said drawer is removable from said second oven cavity and positionable within said first oven cavity to facilitate cleaning said drawer utilizing the self-clean feature of said first oven cavity.

13. An oven assembly in accordance with claim 12 further comprising a gasket coupled to the second oven cavity, and a drawer front coupled to said drawer frame, wherein said gasket is positioned between said second oven cavity and said drawer front to facilitate retaining heat within said second oven cavity.

14. An oven assembly in accordance with claim 12 further comprising a first cooking element and a second cooking element coupled within said second oven cavity.

15. An oven assembly in accordance with claim 12 further comprising insulating material coupled to at least a portion of said second oven cavity.

16. An oven assembly in accordance with claim 12 further comprising a pyrolitic enamel material deposited across an exterior surface of said drawer.

17. An oven assembly in accordance with claim 12 wherein said first oven comprises a cooking rack positioned within said first oven cavity, said drawer is positionable upon said cooking rack to facilitate cleaning said drawer utilizing the self-clean feature of said first oven cavity.

18. An oven assembly in accordance with claim 12 wherein said second oven comprises a baking element and a broiling element.

* * * * *